US011828090B2

(12) United States Patent
Kindstrand et al.

(10) Patent No.: US 11,828,090 B2
(45) **Date of Patent: *Nov. 28, 2023**

(54) HOOP LOCK WITH ANTI-ROTATION FEATURES

(71) Applicant: Schlage Lock Company LLC, Carmel, IN (US)

(72) Inventors: Daniel H. Kindstrand, Tucson, AZ (US); Hassan Charan Kumar, Bangalore (IN); Manjunatha Ramakrishna, Bangalore (IN); David B. Miller, Braintree, MA (US)

(73) Assignee: Schlage Lock Company LLC, Carmel, IN (US)

( * ) Notice: Subject to any disclaimer, the term of this patent is extended or adjusted under 35 U.S.C. 154(b) by 395 days.

This patent is subject to a terminal disclaimer.

(21) Appl. No.: 17/075,286

(22) Filed: Oct. 20, 2020

(65) Prior Publication Data

US 2021/0277688 A1 Sep. 9, 2021

Related U.S. Application Data

(63) Continuation of application No. 16/360,671, filed on Mar. 21, 2019, now Pat. No. 10,808,428, which is a (Continued)

(51) Int. Cl.
*E05B 67/06* (2006.01)

(52) U.S. Cl.
CPC ..... *E05B 67/063* (2013.01); *E05B 2067/066* (2013.01); *Y10T 70/454* (2015.04); (Continued)

(58) Field of Classification Search
CPC ..... E05B 67/063; E05B 2067/066; Y10T 70/454; Y10T 70/459; Y10T 70/491; Y10T 70/5872
(Continued)

(56) References Cited

U.S. PATENT DOCUMENTS 116,977 A 7/1871 McWilliams
526,740 A 10/1894 Rapaport
(Continued)

FOREIGN PATENT DOCUMENTS

CN 2679313 Y 2/2005
DE 2706302 B2 2/1981
(Continued)

OTHER PUBLICATIONS

International Search Report; International Searching Authority; US Patent and Trademark Office; International Application No. PCT/US2015/046572; dated Jan. 7, 2016; 2 pages.
(Continued)

*Primary Examiner* — Suzanne L Barrett
(74) *Attorney, Agent, or Firm* — Taft Stettinius & Hollister LLP

(57) ABSTRACT

A hoop lock including a shackle and a crossbar, with the shackle having a pair of legs extending from a body portion, and each of the legs having a foot including a tip with a non-circular cross-section. The cross-bar includes a housing having a pair of foot-receiving openings and a pair of tip-receiving openings substantially aligned with foot-receiving openings. The tip-receiving openings are configured to matingly engage the tips such that the tips are rotationally coupled to the housing.

25 Claims, 9 Drawing Sheets

Related U.S. Application Data continuation of application No. 15/615,036, filed on Jun. 6, 2017, now Pat. No. 10,240,367, which is a continuation of application No. 14/834,105, filed on Aug. 24, 2015, now Pat. No. 9,670,698.

(60) Provisional application No. 62/040,929, filed on Aug. 22, 2014.

(52) U.S. Cl.
CPC ..... *Y10T 70/459* (2015.04); *Y10T 70/491* (2015.04); *Y10T 70/5872* (2015.04)

(58) Field of Classification Search
USPC ..... 70/39
See application file for complete search history.

(56) References Cited

U.S. PATENT DOCUMENTS

| | | | |
|---|---|---|---|
| 1,490,988 | A | 4/1924 | Soref |
| 2,824,439 | A | 2/1958 | Soref et al. |
| 3,908,415 | A | 9/1975 | Foote |
| 4,674,306 | A | 6/1987 | Halpern |
| 4,881,387 | A | 11/1989 | Kortenbrede |
| 4,918,951 | A | 4/1990 | Kavizky |
| 5,101,646 | A | 4/1992 | Goldman et al. |
| 5,372,019 | A | 12/1994 | Hsiao |
| 5,398,529 | A | 3/1995 | Goldman et al. |
| 5,406,812 | A | 4/1995 | Jaw |
| 5,417,092 | A | 5/1995 | Iu |
| 5,490,402 | A | 2/1996 | Shieh |
| 5,561,996 | A | 10/1996 | Chang |
| 5,921,116 | A | 7/1999 | Goldenberg |
| 6,341,509 | B1 | 1/2002 | McDaid |
| 6,430,975 | B1 | 8/2002 | McDaid |
| 6,584,815 | B2 | 7/2003 | Bremicker |
| 6,694,781 | B1 | 2/2004 | Li |
| 7,389,659 | B1 | 6/2008 | Diaz et al. |
| 7,694,541 | B2 | 4/2010 | Shum |
| 7,823,424 | B2 | 11/2010 | Shabtay et al. |
| 8,061,169 | B2 | 11/2011 | Young |
| 8,127,577 | B2 | 3/2012 | Buhl et al. |
| 8,640,507 | B1 | 2/2014 | Derman |
| 8,839,650 | B2 | 9/2014 | Zuraski |
| 9,670,698 | B2 | 6/2017 | Kindstrand et al. |
| 10,240,367 | B2 | 3/2019 | Kindstrand et al. |
| 10,808,428 | B2 * | 10/2020 | Kindstrand ..... E05B 67/063 |
| 2002/0053226 | A1 | 5/2002 | McDaid |
| 2006/0059962 | A1 | 3/2006 | Shabtay et al. |
| 2009/0049875 | A1 | 2/2009 | Buhl et al. |
| 2011/0162416 | A1 | 7/2011 | Becker |
| 2014/0076010 | A1 | 3/2014 | Gold |
| 2016/0201357 | A1 | 7/2016 | George |
| 2016/0305163 | A1 | 10/2016 | Ramakrishna et al. |

FOREIGN PATENT DOCUMENTS

| | | | |
|---|---|---|---|
| DE | 3228613 | A1 | 2/1984 |
| DE | 4321635 | A1 | 3/1994 |
| DE | 202013103393 | U1 | 8/2013 |

OTHER PUBLICATIONS

Written Opinion; International Searching Authority; US Patent and Trademark Office; International Application No. PCT/US2015/046572; dated Jan. 7, 2016; 7 pages.

Chinese Search Report; State Intellectual Property Office, Peoples Republic of China; Chinese Patent Application No. 201580057577.9; dated Aug. 21, 2018; 3 pages.

Chinese Office Action; State Intellectual Property Office, Peoples Republic of China; Chinese Patent Application No. 201580057577.9; dated Aug. 21, 2018; 8 pages.

Chinese Search Report; State Intellectual Property Office; People Republic of China; Chinese Patent Application No. 201580057577.9; dated Mar. 4, 2019; 3 pages.

Chinese Office Action; State Intellectual Property Office; Peoples Republic of China; Chinese Patent Application No. 201580057577.9; dated Mar. 21, 2019; 9 pages.

Extended European Search Report; European Patent Office; European Patent Application No. 19190222.0; dated Nov. 26, 2019; 8 pages.

Extended Supplementary European Search Report; European Patent Office; European Patent Application No. 15833601.6; dated Feb. 13, 2018; 7 pages.

ABUS U-40 Mini; Urban Velo; Published by Urban Jeff on May 29, 2012; 2 pages.

ABUS Gesamtkatalog 2012 Mobile Sicherheit; 4 pages; Copyright ABUS 2011.

Notice of Opposition to a European Patent; European Patent Office; Patent Application No. EP19190222.0; dated Jan. 26, 2022; 69 pages.

Written Submission to European Opposition of EP3584394; European Patent Office; Patent Application No. EP19190222.0; 69 pages.

* cited by examiner

HOOP LOCK WITH ANTI-ROTATION FEATURES

CROSS-REFERENCE TO RELATED APPLICATIONS

The present application is a continuation of U.S. patent application Ser. No. 16/360,671 filed Mar. 21, 2019 and issued as U.S. Pat. No. 10,808,428, which is a continuation of U.S. patent application Ser. No. 15/615,036 filed Jun. 6, 2017 and issued as U.S. Pat. No. 10,240,367, which is a continuation of U.S. patent application Ser. No. 14/834,105 filed Aug. 24, 2015 and issued as U.S. Pat. No. 9,670,698, which claims the benefit of U.S. Provisional Application Ser. No. 62/040,929 filed on Aug. 22, 2014, the contents of each application are hereby incorporated herein by reference in their entirety.

TECHNICAL FIELD

The present invention generally relates to hoop locks, and more particularly, but not exclusively, to hoop locks having a removable shackle.

BACKGROUND

Hoop locks are commonly used to secure a portable object such as a bicycle to a stationary object such as a rack. These types of hoop locks are sometimes referred to as shackle locks, U-locks, or bicycle locks. Some locks of this type have certain limitations, such as those relating to resistance to tampering and attack. Therefore, a need remains for further improvements and developments in this area of technology.

SUMMARY

An exemplary hoop lock includes a shackle and a cross-bar. The shackle includes a pair of legs extending from a body portion. Each of the legs includes a foot comprising a tip with a non-circular cross-section. The cross-bar comprises a housing including a pair of foot-receiving openings, and a pair of tip-receiving openings aligned with the foot-receiving openings. The tip-receiving openings are configured to matingly engage the tips such that the tips are rotationally coupled to the housing. Further embodiments, forms, features, and aspects of the present application shall become apparent from the description and figures provided herewith.

DETAILED DESCRIPTION OF ILLUSTRATIVE EMBODIMENTS

Figure 1:
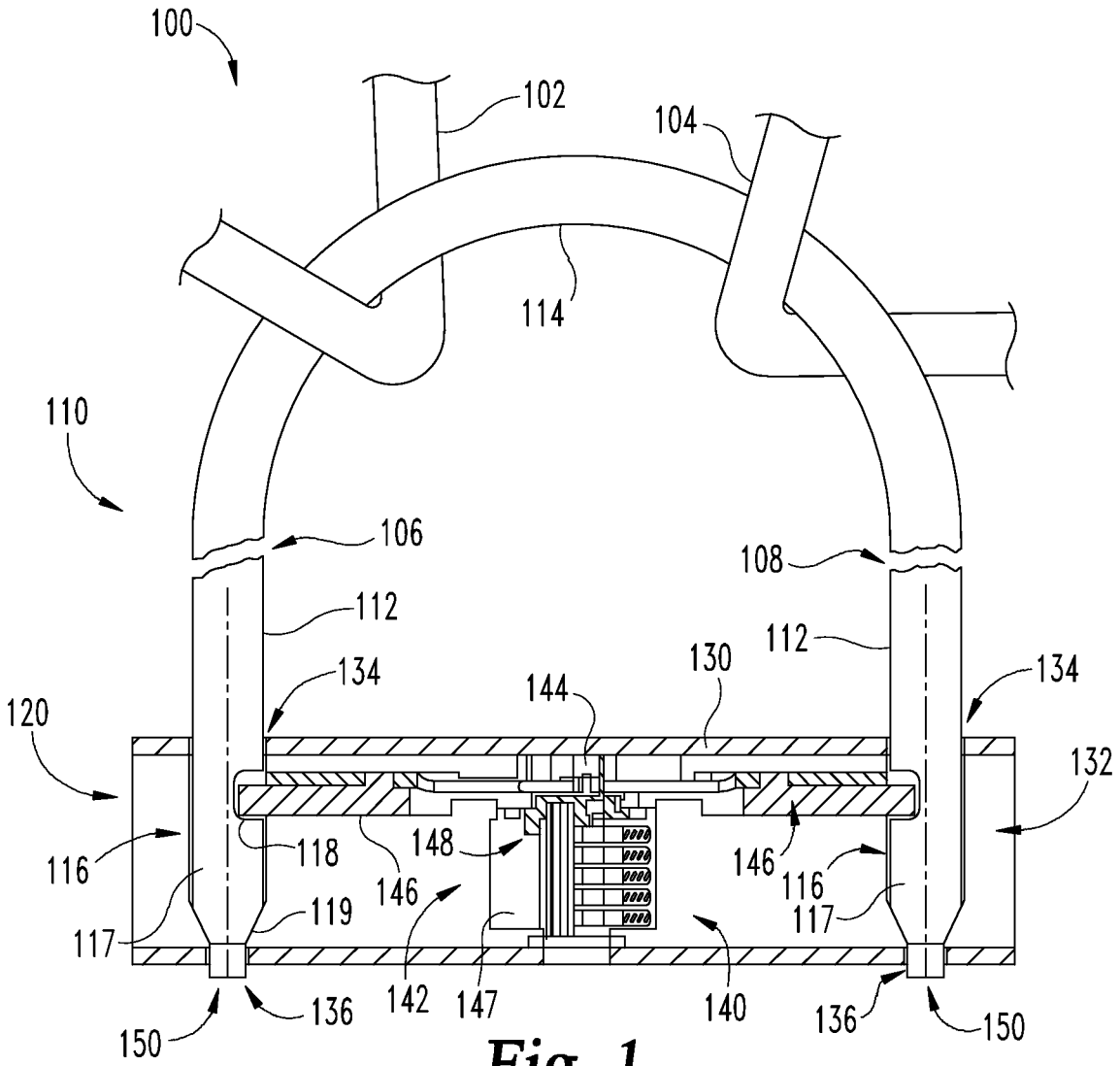
FIG. 1 is a cross-sectional illustration of a hoop lock including a shackle according to one embodiment.

For the purposes of promoting an understanding of the principles of the invention, reference will now be made to the embodiments illustrated in the drawings and specific language will be used to describe the same. It will nevertheless be understood that no limitation on the scope of the invention is hereby intended. Any alterations and further modifications in the described embodiments, and any further applications of the principles of the invention as described herein are contemplated as would normally occur to one skilled in the art to which the invention relates.

Figure 2:
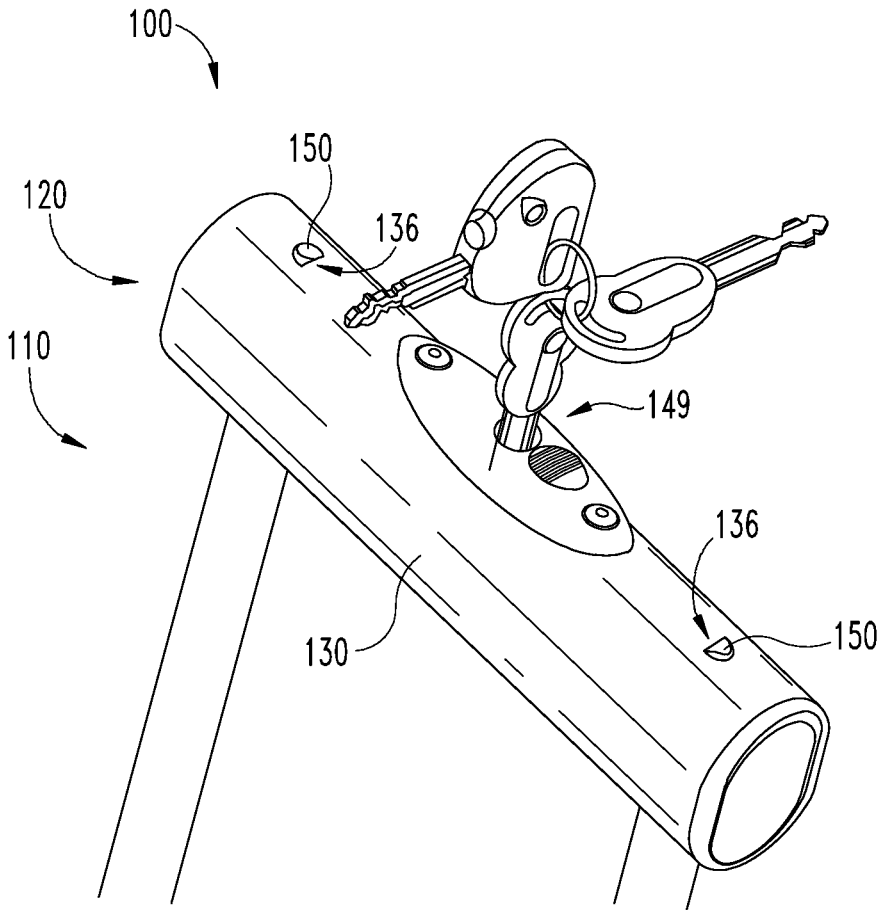
FIG. 2 is a perspective illustration of a portion of the hoop lock illustrated in FIG. 1.

With reference to FIGS. 1 and 2, a hoop lock 100 according to one embodiment generally comprises a shackle 110 and a crossbar 120, which includes a housing 130 and a locking mechanism 140. As described in further detail below, the shackle 110 and crossbar 120 are separable, and the locking mechanism 140 is configured to selectively secure the crossbar 120 to the shackle 110. The lock 100 may be used to secure a first object 102 to a second object 104 such as, for example, to prevent unauthorized separation or theft of the objects 102, 104.

The illustrative shackle 110 includes a pair of legs 112 extending from opposite ends of a central body 114. In the illustrated form, the legs 112 are arranged substantially parallel to one another, and the central body 114 is curved or arcuate-shaped such that the shackle 110 is substantially U-shaped. However, it is also contemplated that the shackle 110 may take on another shape or configuration. For example, the central body 114 may be substantially rectilinear, or portions of the legs 112 may be obliquely offset from one another.

Each of the legs 112 comprises a foot 116, and the feet 116 are arranged substantially parallel to one another. Each foot 116 includes cylindrical portion 117, a groove 118 formed in the cylindrical portion 117, and a tip 150. One or both of the legs 112 may include a frustoconical tapered portion 119 connecting the cylindrical portion 117 to the corresponding tip 150. When the shackle 110 is coupled to the crossbar 120, each foot 116 is positioned in the housing 130. While other geometries are contemplated, the illustrated legs 112, feet 116, and tapered portions 119 each have a substantially circular cross-section. Each of the tips 150, however, has a non-circular cross-section, as will be illustrated and described in further detail below.

The exemplary housing 130 is configured as a tube defining an internal cavity 132 in which the locking mechanism 140 is positioned and seated. The housing 130 includes a pair of foot-receiving openings 134 and a pair of tip-receiving openings 136 aligned with the foot-receiving openings 136. The foot-receiving openings 134 are sized and configured to receive the feet 116, and the tip-receiving openings 136 are sized and configured to receive the tips 150. As illustrated in FIG. 2, when the shackle 110 is coupled to the crossbar 120, the tips 150 are positioned or seated in the tip-receiving openings 136.

The locking mechanism 140 is configured to secure the shackle 110 to the crossbar 120 in a locked state, and to permit separation of the shackle 110 and the crossbar 120 in an unlocked state. The illustrative locking mechanism 140 generally includes a lock cylinder 142, a cam 144 connected to the lock cylinder 142, and a pair of deadbolts 146 engaged with the cam 144. The lock cylinder 142 includes a shell 147 coupled to the housing 130, and a spindle 148 which is rotatable with respect to the shell 147 upon insertion of a proper key 149 (FIG. 2). The cam 144 is rotationally coupled with the spindle 148, and is configured to extend and retract the deadbolts 146 in response to rotation of the spindle 148. While the illustrated lock mechanism 140 includes a key-operable lock cylinder 142, it is also contemplated that other forms of lock mechanism may be utilized. For example, in certain embodiments, the lock mechanism 140 may include a combination lock mechanism in addition to or in lieu of the lock cylinder 142.

In FIG. 1, the deadbolts 146 are positioned in an extended position and are engaged with the feet 116. More specifically, the end of each deadbolt 146 is received in the groove 118 of one of the feet 116. With the deadbolts 146 engaged with the feet 116, the shackle 110 cannot be removed from the crossbar 120, thereby defining the locked state. When the key 149 is inserted and the spindle 148 is rotated, the cam 144 retracts the deadbolts 146 to a retracted position. In the retracted position, the deadbolts 146 do not engage the feet 116, and the shackle 110 can be separated from the crossbar 120, thereby defining the unlocked state.

Figure 3:
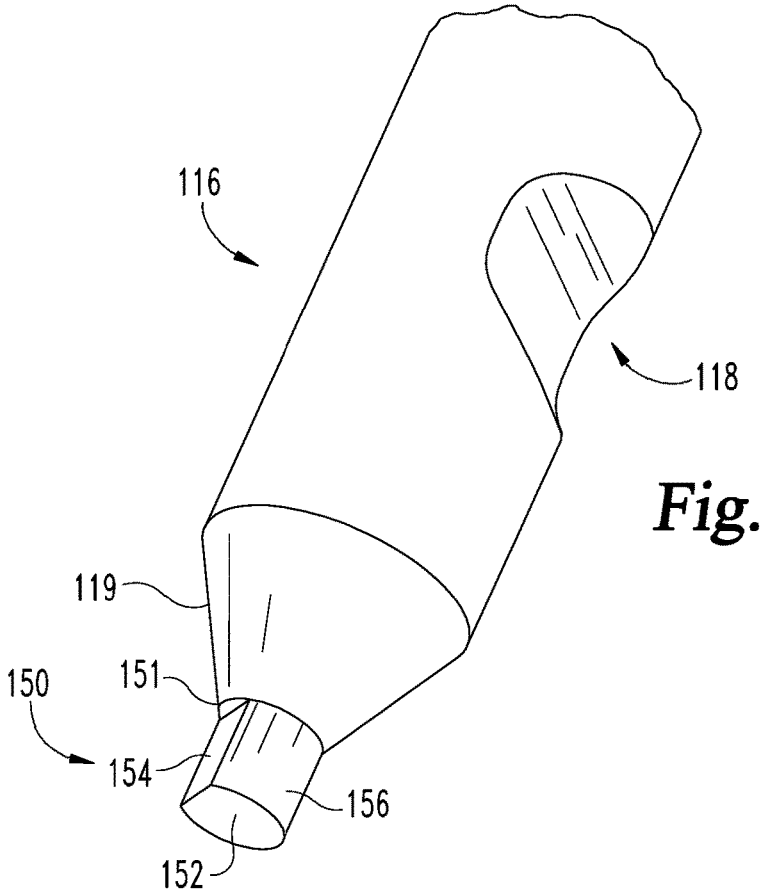
FIG. 3 is a perspective illustration of a distal end portion or foot of the shackle illustrated in FIG. 1.
Figure 4:
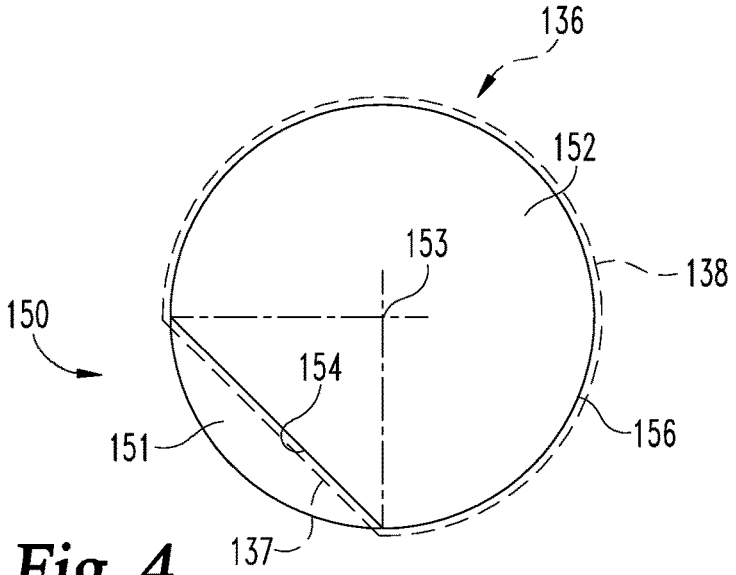
FIG. 4 is an end view of the distal tip of the foot illustrated in FIG. 3.

With additional reference to FIGS. 3 and 4, each tip 150 extends from a base 151 to an end surface 152. The base 151 is defined by the terminus of the tapered portion 119, and is substantially circular about a center point 153. As illustrated in FIG. 4, each tip 150 has a non-circular cross-sectional geometry, and each tip-receiving opening 136 has a geometry corresponding to that of the tip 150. In the illustrated form, the tip 150 includes a flat engagement surface 154 and a curved or arcuate side surface 156 which defines a segment of a circle formed about the center point 153. The engagement surface 154 may, for example, define a 45° angle with respect to two perpendicular radii of the arcuate surface 156. While the illustrated engagement surface 154 is obliquely offset with respect to a depth dimension of the groove 118, it is also contemplated that the engagement surface 154 may be arranged parallel or perpendicular to the depth dimension of the groove 118.

During manufacture, the tip 150 may initially be configured as a substantially cylindrical tip extending from the circular base 151. The engagement surface 154 may be formed by milling or machining away a portion of the cylindrical tip. For example, a milling bit may be passed along a straight line offset from and arranged parallel to a diameter of the base 151.

With specific reference to FIGS. 2 and 4, when the shackle 110 is coupled to the crossbar 120, the non-circular tips 150 are received in the tip-receiving openings 136. The tip-receiving openings 136 are configured to receive and matingly engage the tips 150 such that the tips 150 are rotationally coupled to the housing 130. Each of the tip-receiving openings 136 may have a geometry corresponding to the non-circular cross-section of the tip 150. As illustrated in FIG. 4, each tip-receiving opening 136 includes a flat engagement edge 137 corresponding to the flat engagement surface 154, and a curved or arcuate edge 138 corresponding to the curved or arcuate side surface 156. The tip-receiving openings 136 and the tips 150 may be configured such that each tip-receiving opening 136 is capable of receiving each of the tips 150, thereby enabling the shackle 110 to be coupled to the crossbar 120 in either of two orientations. For example, the tip-receiving openings 136 may be mirror images of one another, and the tips 150 may likewise be mirror images of one another.

A common form of attempting to defeat a hoop lock (such as the lock 100) is to cut through one of the legs 112, as depicted by the cut 106 illustrated in FIG. 1. Once the leg 112 is cut, the attacker manually rotates the uncut leg 112, using the central body 114 as a lever arm. If the central body 114 is sufficiently rotated, a gap forms at the cut 106, thereby allowing one or both of the objects 102, 104 to be removed from the shackle 110 through the gap. While the deadbolts of conventional hoop locks resist rotation of the legs, it has been found that certain conventional systems remain susceptible to the above-described type of cut attack.

With the shackle 110 coupled to the crossbar 120 as described above, engagement between the tip-receiving openings 136 and the tips 150 rotationally couples the feet 116 to the housing 130. As a result, the crossbar 120 substantially prevents rotation of the legs 112, thereby preventing formation of the above-described gap. The term "substantially" as used herein may be applied to modify a quantitative representation which could permissibly vary without resulting in a change in the basic function to which it relates. For example, with the tip 150 engaged with the tip-receiving opening 136, the leg 116 may permissibly be capable of slight rotation if the above-described gap formation is prevented. With the legs 112 unable to rotate, the attacker must make a second cut 108 in the shackle 110 such that a portion of the shackle 110 can be removed to form a gap through which the objects 102, 104 can be passed.

FIGS. 5-10 depict tip-receiving openings and feet including tips according to other embodiments. The tip-receiving openings, feet, and tips are shaped and configured substantially similar to the tip-receiving openings 136, feet 116 and tips 150. Unless indicated otherwise, similar reference characters are used to indicate similar elements and features. In the interest of conciseness, the following descriptions focus primarily on features that are different than those described above with regard to the tip-receiving openings 136, feet 116 and tips 150.

Figure 5:
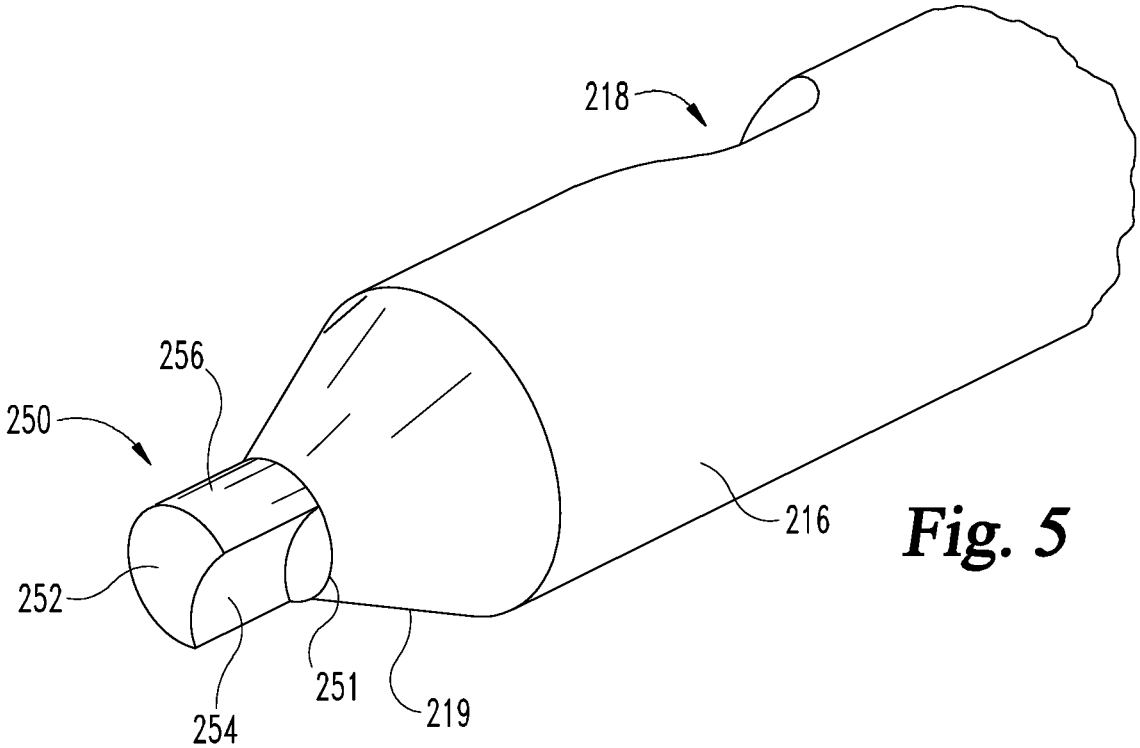
FIG. 5 is a perspective illustration of a distal end portion or foot of a shackle according to another embodiment.
Figure 6:
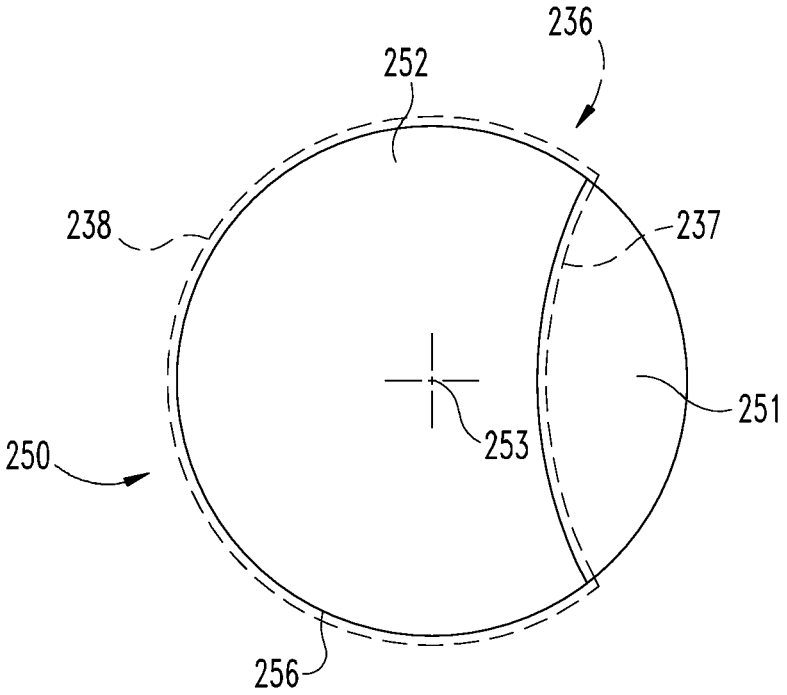
FIG. 6 is an end view of the distal tip of the foot illustrated in FIG. 5.

With reference to FIGS. 5 and 6, a tip 250 according to one embodiment includes a curved or arcuate side surface 256 and a concave arcuate engagement surface 254. The tip-receiving opening 236 has a geometry corresponding to that of the tip 250, and includes a convex engagement edge 237 corresponding to the concave engagement surface 254. In the illustrated form, the arcuate engagement surface 254 has an arc radius greater than that of the arcuate side surface 256. In other embodiments, the arc radius of the concave engagement surface 254 may be equal to or less than that of the arcuate side surface 256. Additionally, while the exemplary engagement surface 254 is formed on the opposite side of the center point 253 as the groove 218, it is also contemplated that the engagement surface may be oriented and arranged in another manner.

During manufacture, the tip 250 may begin as a substantially cylindrical tip having a circular cross-section corresponding to that of the base 251, and the engagement surface 254 may be formed by milling or machining away a portion of the cylindrical tip. For example, a milling bit may be passed along a straight line toward the center point 253 such that the engagement surface 254 has a radius of curvature corresponding to the radius of the milling bit.

Figure 7:
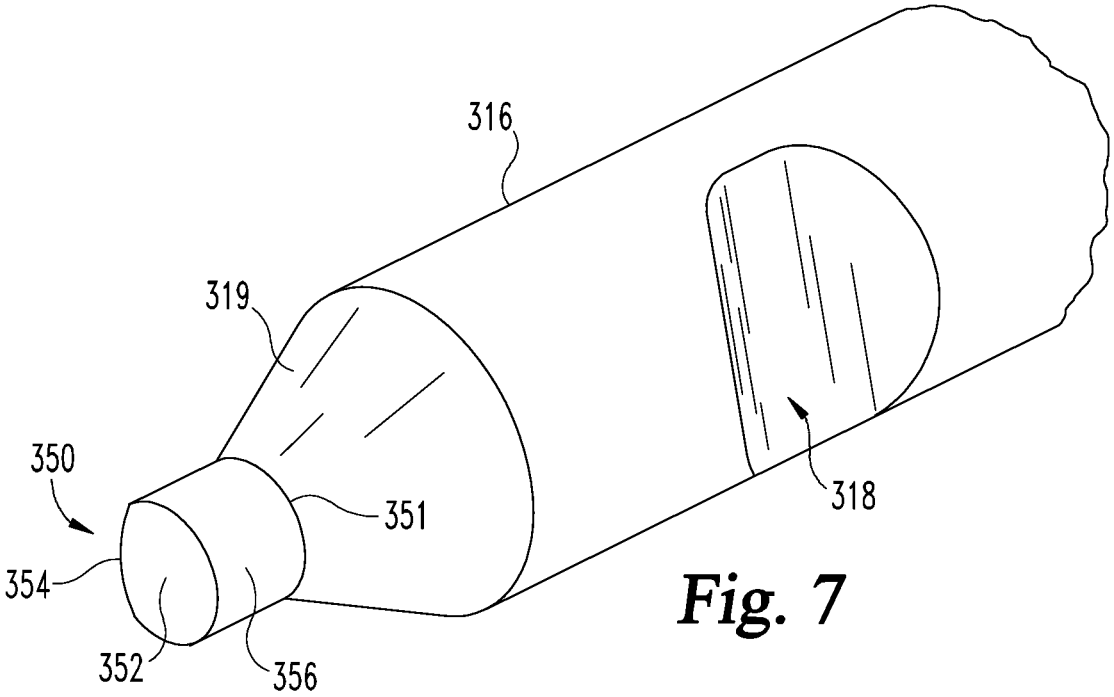
FIG. 7 is a perspective illustration of a distal end portion or foot of a shackle according to another embodiment.
Figure 8:
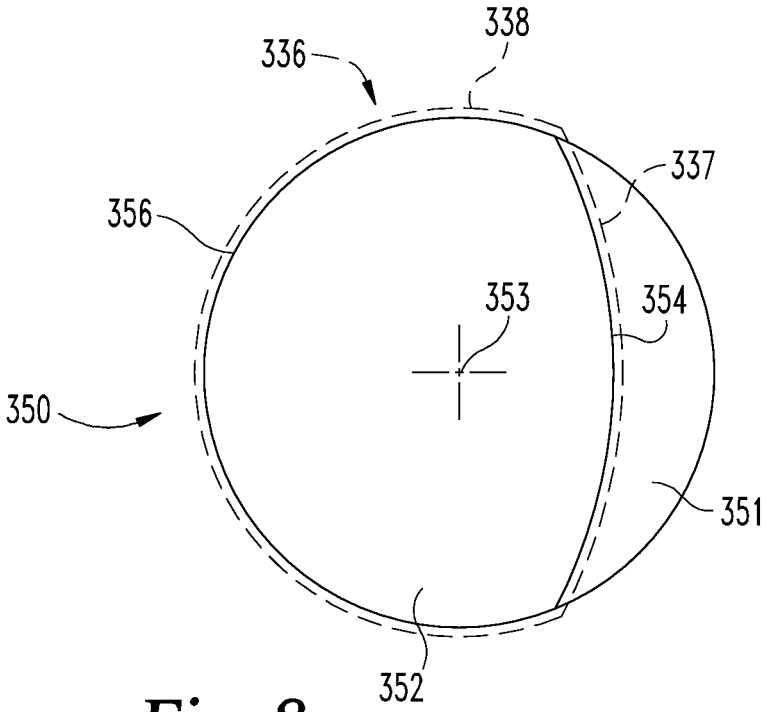
FIG. 8 is an end view of the distal tip of the foot illustrated in FIG. 7.

With reference to FIGS. 7 and 8, a tip 350 according to another embodiment includes a convex engagement surface 354 which has an arc radius greater than that of the arcuate side surface 356. The tip-receiving opening 336 is defined, in part, by a concave engagement edge 337 corresponding to the convex engagement surface 354.

Figure 9:
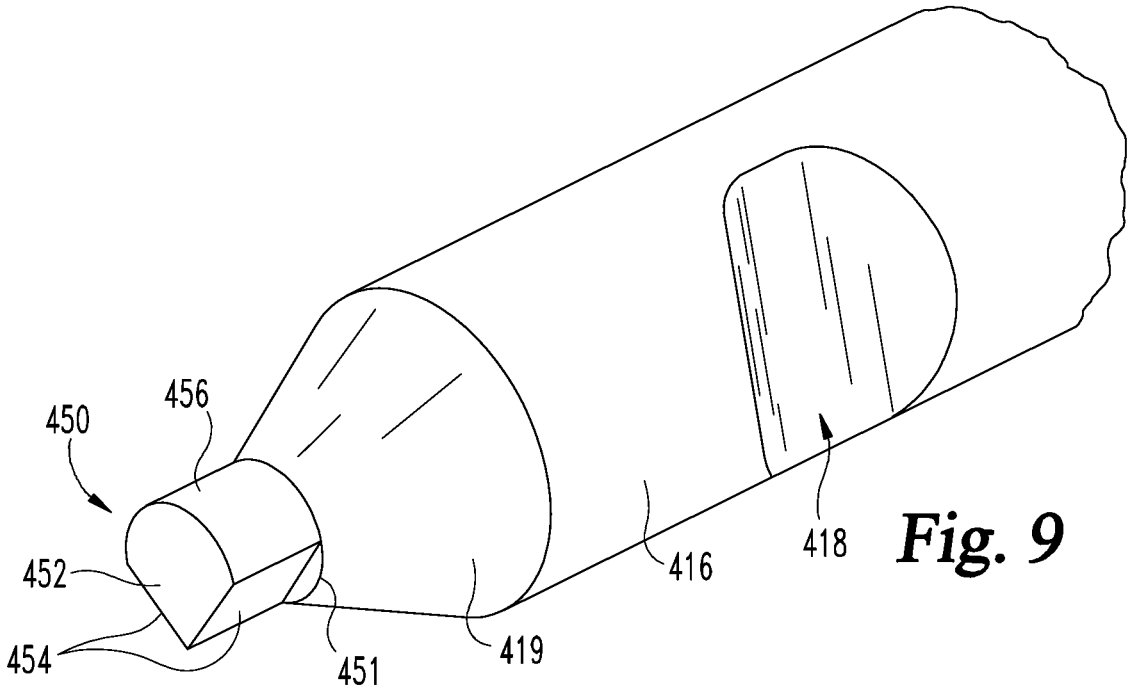
FIG. 9 is a perspective illustration of a distal end portion or foot of a shackle according to another embodiment.
Figure 10:
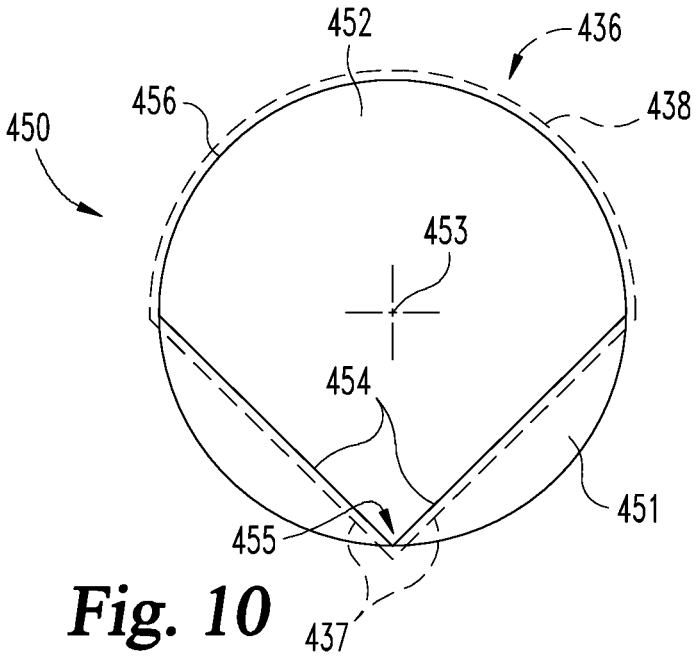
FIG. 10 is an end view of the distal tip of the foot illustrated in FIG. 9.

With reference to FIGS. 9 and 10, a tip 450 according to another embodiment includes a pair of flat engagement surfaces 454 that join or intersect one another at a vertex 455. The tip-receiving opening 436 likewise includes a pair of engagement edges 437 joining one another at a vertex. While the illustrated engagement surfaces 454 are arranged substantially perpendicular to one another, it is also contemplated that the engagement surfaces 454 may be offset from one another at an oblique angle. In such forms, the engagement edges 437 may be offset from one another at a substantially equivalent oblique angle.

Figure 11:
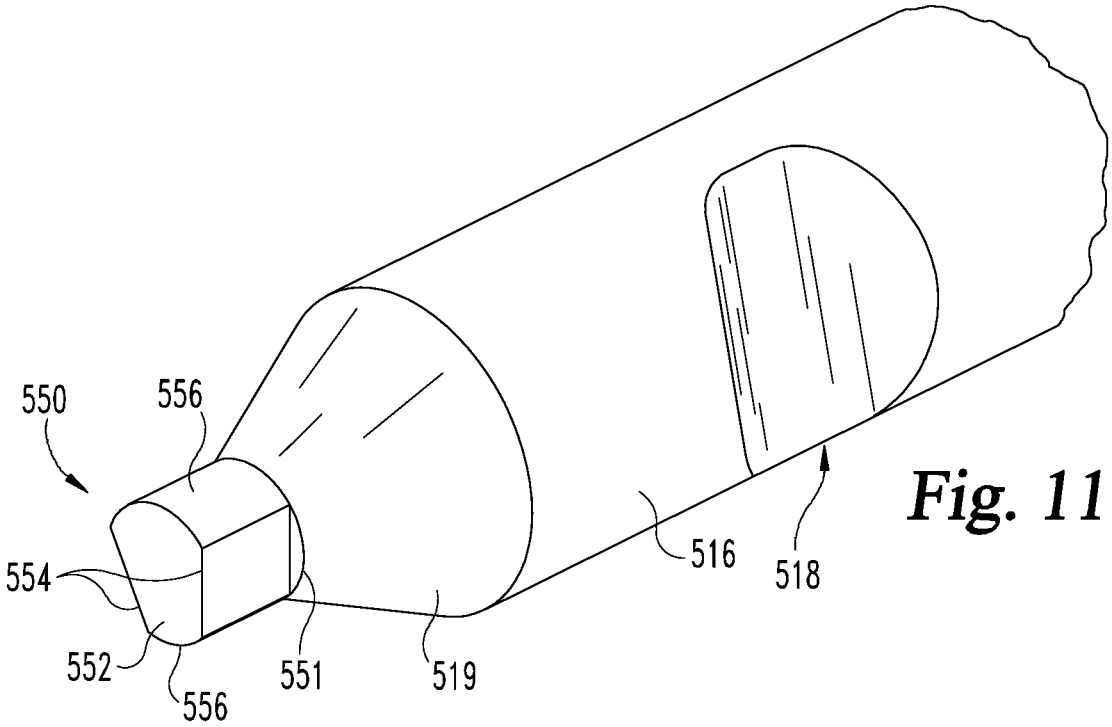
FIG. 11 is a perspective illustration of a distal end portion or foot of a shackle according to another embodiment.
Figure 12:
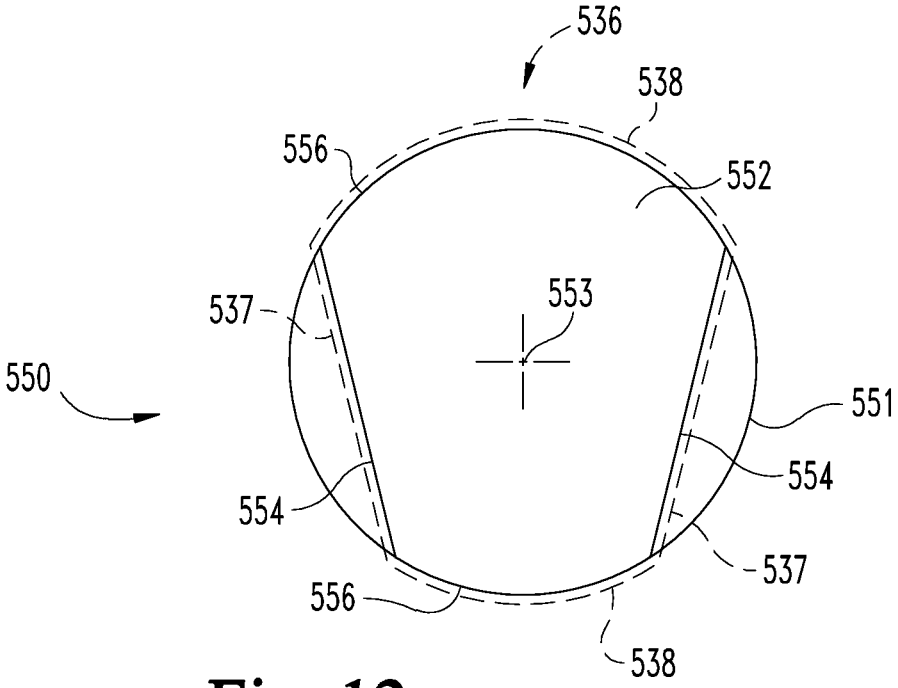
FIG. 12 is an end view of the distal tip of the foot illustrated in FIG. 11.

With reference to FIGS. 11 and 12, a tip 550 according to another embodiment includes a pair of engagement surfaces 554 and a pair of curved or arcuate side surfaces 556 connecting the engagement surfaces 554. The tip-receiving opening 536 likewise includes a pair of flat engagement edges 537 and a pair of arcuate edges 538 connecting the engagement edges 537. In the illustrated form, the engagement surfaces 554 are obliquely offset from one another. In other embodiments, two or more flat engagement surfaces may be arranged parallel with or perpendicular to one another, and at least some of the flat engagement surfaces may be formed adjacent the curved or arcuate side surfaces.

FIGS. 13-16 depict feet including tips according to further embodiments. Each of the feet is configured substantially similar to the feet 116, and each of the tips is configured substantially similar to the tips 150. Unless indicated otherwise, similar reference characters are used to indicate similar elements and features. In the interest of conciseness, the following descriptions focus primarily on features that are different than those described above with regard to the feet 116 and tips 150. While not specifically illustrated, it should be understood that a tip-receiving opening in each of the embodiments described hereinafter may have a shape corresponding to that of the tip.

Figure 13A:
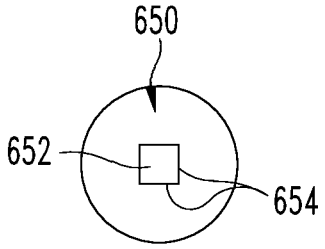
FIGS. 13*a* and 13*b* respectively illustrate an end view and a side view of a distal tip of the foot of a shackle according to another embodiment.
Figure 13B:
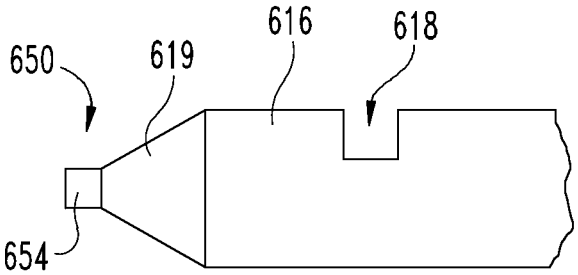

With reference to FIGS. 13*a* and 13*b*, a tip 650 according to another embodiment includes four flat engagement surfaces 654. Each of the engagement surfaces 654 is arranged either parallel or perpendicular to a depth dimension of the groove 618 such that the face 652 is substantially square-shaped. Additionally, the tip 650 is positioned and arranged generally concentric with the foot 616, and the greatest dimension of the face 652 is less than the diameter of the foot 616.

Figure 14A:
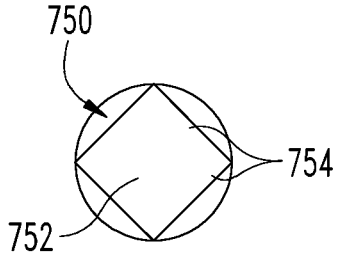
FIGS. 14*a* and 14*b* respectively illustrate an end view and a side view of a distal tip of the foot of a shackle according to another embodiment.
Figure 14B:
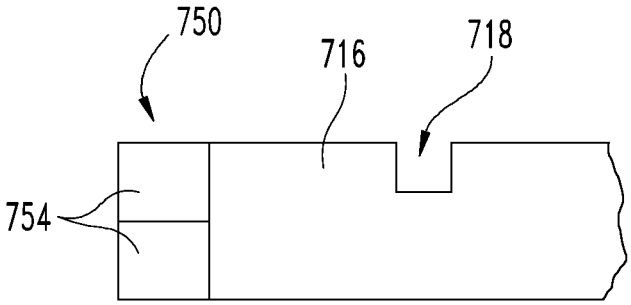

With reference to FIGS. 14*a* and 14*b*, a tip 750 according to another embodiment includes four flat engagement surfaces 754. Each of the engagement surfaces 754 is angularly offset, for example, by about 45° with respect to a depth dimension of the groove 718, thereby resulting in a face 752 that is diamond-shaped. Additionally, the greatest dimension of the face 752 is substantially equal to the diameter of the foot 716 such that the diamond-shaped face 752 is circumscribed by the circular cross-section of the foot 716.

Figure 15A:
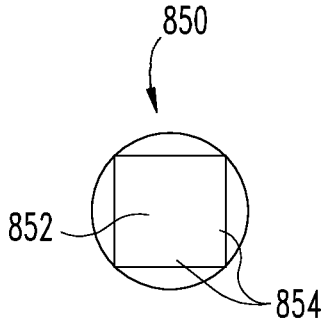
FIGS. 15*a* and 15*b* respectively illustrate an end view and a side view of a distal tip of the foot of a shackle according to another embodiment.
Figure 15B:
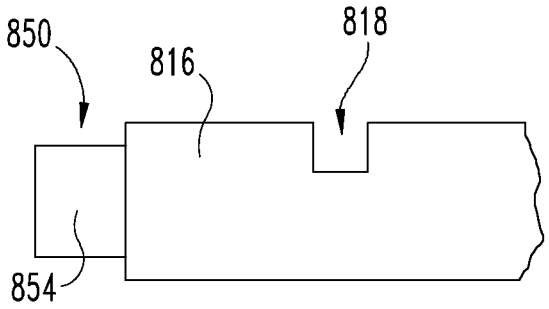

With reference to FIGS. 15*a* and 15*b*, a tip 850 according to another embodiment includes four flat engagement surfaces 854. Each of the engagement surfaces 854 is arranged either parallel or perpendicular to a depth dimension of the groove 818 such that the face 852 is substantially square-shaped. Additionally, the greatest dimension of the face 852 is substantially equal to the diameter of the foot 816 such that the square-shaped face 852 is circumscribed by the circular cross-section of the foot 816.

Figure 16A:
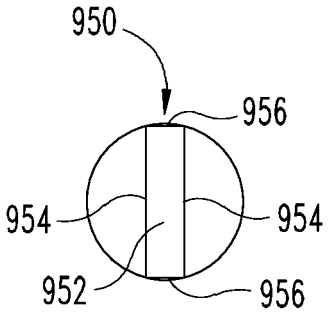
FIGS. 16*a* and 16*b* respectively illustrate an end view and a side view of a distal tip of the foot of a shackle according to another embodiment.
Figure 16B:
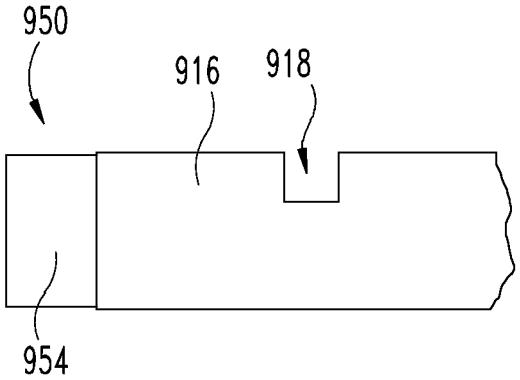

With reference to FIGS. 16*a* and 16*b*, a tip 950 according to another embodiment includes a pair of parallel engagement surfaces 954 connected by a pair of curved or arcuate surfaces 956. In the illustrated form, the engagement surfaces 954 are arranged substantially parallel to the depth dimension of the groove 918. In other embodiments, the engagement surfaces 954 may be arranged substantially perpendicular to or obliquely offset with respect to the depth dimension of the groove 918.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected.

It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus, comprising:

a shackle including first and second tip portions that each define a non-circular outer cross section;

a tubular cross-bar having an inner surface and an outer surface, the tubular cross-bar extending in a longitudinal direction and defining a pair of first openings extending from the outer surface to the inner surface and offset from one another in the longitudinal direction, the tubular cross-bar further defining a pair of second openings having a non-circular inner cross section and extending from the inner surface toward the outer surface and offset from one another in the longitudinal direction, wherein the first and second tip portions are inserted through the pair of first openings and received in the pair of second openings; and a lock having a locked state which retains the shackle in engagement with the tubular cross-bar and an unlocked state which permits removal of the shackle from the tubular cross-bar; and wherein the non-circular outer cross section of each of the first and second tip portions comprises an arcuate segment and at least one additional segment, and wherein the at least one additional segment comprises at least one additional curved segment.

2. The apparatus of claim 1, wherein the non-circular outer cross section of each of the first and second tip portions is crescent-shaped.

3. The apparatus of claim 1, wherein the non-circular outer cross section of each of the first and second tip portions further comprises at least one straight segment.

4. The apparatus of claim 3, wherein the at least one straight segment comprises a first straight segment and a second straight segment.

5. The apparatus of claim 4, wherein the first straight segment and the second straight segment connect the arcuate segment and the at least one additional curved segment.

6. The apparatus of claim 4, wherein the first straight segment and the second straight segment are obliquely offset relative to one another.

7. The apparatus of claim 6, wherein the first straight segment and the second straight segment are parallel to one another.

8. The apparatus of claim 2, wherein the at least one curved segment defines a concave curvature.

9. The apparatus of claim 1, wherein the non-circular inner cross section of the second openings corresponds in size and shape to a size and shape of the non-circular outer cross section of the tip portions.

10. The apparatus of claim 1, wherein the shackle is substantially U-shaped.

11. The apparatus of claim 1, wherein the tubular cross-bar is cylindrical.

12. The apparatus of claim 1, wherein one of the arcuate segment and the at least one additional curved segment comprises a concave segment.

13. The apparatus of claim 12, wherein another of the arcuate segment and the at least one additional curved segment comprises a convex segment.

14. The apparatus of claim 1, wherein the arcuate segment defines a portion of a circle, and wherein the at least one additional curved segment is not defined by the circle.

15. An apparatus, comprising:

a shackle including first and second tip portions that each define a non-circular outer cross section, wherein the outer cross section of each of the first and second tip portions is crescent-shaped;

a tubular cross-bar having an inner surface and an outer surface, the tubular cross-bar extending in a longitudinal direction and defining a pair of first openings extending from the outer surface to the inner surface and offset from one another in the longitudinal direction, the tubular cross-bar further defining a pair of second openings having a non-circular inner cross section and extending from the inner surface toward the outer surface and offset from one another in the longitudinal direction, wherein the first and second tip portions are inserted through the pair of first openings and received in the pair of second openings; and a lock having a locked state which retains the shackle in engagement with the tubular cross-bar and an unlocked state which permits removal of the shackle from the tubular cross-bar.

16. The apparatus of claim 15, wherein the crescent-shaped outer cross section of each of the first and second tip portions includes a convex segment and a concave segment.

17. An apparatus, comprising:

a shackle including a pair of legs and a tip portion;

a tubular cross-bar extending in a longitudinal direction and having an inner surface and an outer surface, the tubular cross-bar including aligned first and second openings, wherein the first opening extends from the outer surface to the inner surface of the tubular cross-bar with a corresponding one of the pair of legs inserted through the first opening, wherein the second opening extends from the inner surface toward the outer surface of the tubular cross-bar with the tip portion received in the second opening, and wherein an outer cross section of the tip potion and an inner cross section of the second opening each have a non-circular shape; and a lock having a locked state which retains the shackle in engagement with the tubular cross-bar and an unlocked state which permits removal of the shackle from the tubular cross-bar; and wherein the outer cross section of the tip portion comprises an arcuate segment defining a portion of a circle, and an additional curved segment that is not defined by the circle.

18. The apparatus of claim 17, wherein the inner cross section of the second opening has a size and shape corresponding to a size and shape of the outer cross section of the tip portion.

19. The apparatus of claim 17, wherein the outer cross section of the tip portion is crescent-shaped.

20. The apparatus of claim 17, wherein the shackle is substantially U-shaped.

21. The apparatus of claim 17, wherein the tubular cross-bar is cylindrical.

22. The apparatus of claim 17, wherein one of the arcuate segment and the additional curved segment comprises a concave segment.

23. The apparatus of claim 22, wherein another of the arcuate segment and the additional curved segment comprises a convex segment.

24. An apparatus, comprising:

a shackle including a pair of legs and a tip portion;

a tubular cross-bar extending in a longitudinal direction and having an inner surface and an outer surface, the tubular cross-bar including aligned first and second openings, wherein the first opening extends from the outer surface to the inner surface of the tubular cross-bar with a corresponding one of the pair of legs inserted through the first opening, wherein the second opening extends from the inner surface toward the outer surface of the tubular cross-bar with the tip portion received in the second opening, and wherein an outer cross section of the tip potion and an inner cross section of the second opening each have a non-circular shape, and wherein the outer cross section of the tip portion and the inner cross section of the second opening comprises a convex portion and a concave portion; and a lock having a locked state which retains the shackle in engagement with the tubular cross-bar and an unlocked state which permits removal of the shackle from the tubular cross-bar.

25. The apparatus of claim 24, wherein the outer cross section of the tip portion is crescent-shaped.

* * * * *